US005918502A

United States Patent [19]

Bishop

[11] Patent Number: 5,918,502

[45] Date of Patent: Jul. 6, 1999

[54] FOOTWEAR INCORPORATING PIEZOELECTRIC SPRING SYSTEM

[75] Inventor: Richard Patten Bishop, Fairfax Station, Va.

[73] Assignee: Face International Corporation, Norfolk, Va.

[21] Appl. No.: 09/136,997

[22] Filed: Aug. 20, 1998

Related U.S. Application Data

[60] Provisional application No. 60/057,474, Sep. 3, 1997.

[51] Int. Cl.[6] ..... A61B 5/00

[52] U.S. Cl. ..... 73/172; 36/136

[58] Field of Search ..... 73/862.043, 172; 36/1–182

[56] References Cited

U.S. PATENT DOCUMENTS

| | | | |
|---|---|---|---|
| 4,848,009 | 7/1989 | Rodgers | 36/137 |
| 5,188,447 | 2/1993 | Chiang et al. | 36/103 |
| 5,471,721 | 12/1995 | Haertling | 29/25.35 |
| 5,500,635 | 3/1996 | Mott | 36/137 |
| 5,632,841 | 5/1997 | Hellbaum et al. | 156/245 |
| 5,714,706 | 2/1998 | Nakada et al. | 36/139 |
| 5,746,499 | 5/1998 | Ratcliffe et al. | 36/103 |
| 5,765,300 | 6/1998 | Kianka | 36/139 |
| 5,797,201 | 8/1998 | Huang | 36/132 |

*Primary Examiner*—Elizabeth L. Dougherty
*Attorney, Agent, or Firm*—Stephen E. Clark

[57] ABSTRACT

An article of performance enhancing footwear having a piezoelectric spring apparatus in the sole member. Walking or running applies a first force deforming a piezoelectric actuator, thereby generating electrical energy. An energy storage circuit stores electrical energy generated by the piezoelectric actuator. Sensing means is provided to sense the release of a second force greater than the first force, which triggers the release of stored electrical energy back into the piezoelectric actuator. The resulting deformation of the piezoelectric actuator imparts a force into the bottom contact surface of the sole member.

6 Claims, 5 Drawing Sheets

FOOTWEAR INCORPORATING PIEZOELECTRIC SPRING SYSTEM

This application is a provision of application Ser. No. 60,057,474 filed Sep. 3,1997.

BACKGROUND OF THE INVENTION

1. Field of Invention

The present invention relates to performance enhancing footwear. More specifically the present invention relates to footwear incorporating at least one piezoelectric spring which, when activated, enables the wearer of the footwear to jump higher or run faster.

2. Description of the Prior Art

The present invention is a unique article of footwear which incorporates a piezoelectric spring system which may be advantageously used in a preferred embodiment of the invention to enable the wearer of said article of footwear to run faster or jump higher than without said article of footwear. Energy generated by a piezoelectric element as a result of the impact of the footwear against the ground is stored in an energy storage circuit and is later released at an advantageous time.

The prior art includes devices which emit light when the footwear impacts or departs from the ground. Lighted footwear seen in the prior art typically comprises one or more sources of electric light, a small portable power source, such as a dry-cell battery, and electrical circuitry to connect the power source to the light sources electrically, which circuitry usually includes sensing means for sensing the desirable dynamic forces and switching the light sources on and off in a desirable fashion.

In U.S. Pat. No. 45,188,447, L. Chiang, et al., describe a lighted footwear system in which the lights are actuated by the impact of the footwear against an object, such as the ground. In this prior system, a piezoelectric crystal operates as a voltage generator to generate a brief voltage pulse, the amplitude of which is related to the amount of inertial force incident upon the crystal. The voltage pulse is used as the input of the battery-driven amplifier, which, in turn, drives the lights, such that the intensity of the single pulse of light emitted by the lights is related to the amount of force with which the footwear impacts the object. The Chiang, et al. device and other prior lighted footwear devices create a lighted effect that is novel and pleasing to the eye, but does not enhance the wearer's performance characteristics (i.e., running or jumping) in any way.

Accordingly, an inertially responsive article of footwear which is actuated by impact of the footwear against the ground and which improves the wearer's running and jumping capabilities and which incorporates a piezoelectric element capable of sustaining high loads is highly desirable.

SUMMARY OF THE INVENTION

In view of the foregoing disadvantages in the prior art, the present invention provides an article of footwear which stores energy generated by a piezoelectric element as a result of the impact of the footwear against the ground, and advantageously releases said stored energy on demand—(i.e., so as to supplement the force by which the wearer pushes off the ground when running or jumping). The footwear comprises a piezoelectric element which generates a voltage potential when deformed by the impact of the footwear against an object, such as the ground. The voltage is stored in energy storage circuitry for later use.

At a later time, such as upon the footwear's departure from the ground, the stored voltage is reapplied to the piezoelectric element, causing the element (as well as the footwear itself) to snap or spring, thus allowing the wearer of the footwear to run faster or jump higher.

Accordingly, it is an object of the present invention to provide an article of footwear which enables the wearer of the footwear to run faster or jump higher.

It is a further object of the present invention to provide a device of the character described which stores the energy generated by the piezoelectric element upon impact of the footwear against the ground.

It is a further object of the present invention to provide a device of the character described in which a piezoelectric element is deformed by the impact of the footwear against the ground.

It is a further object of the present invention to provide a device of the character described in which the voltage potential created by the deformation of the piezoelectric element is stored in energy storage circuitry for use at a later, predetermined time.

It is another object of the present invention to provide a device of the character described wherein the stored voltage is reapplied to the piezoelectric element upon the occurrence of a predetermined condition, thus causing the piezoelectric element to deform.

It is another object of the present invention to provide a device of the character described which is inexpensive and of a simple and uncluttered design.

Further objects and advantages of this invention will become apparent from a consideration of the drawings and ensuing description thereof.

DESCRIPTION OF THE PREFERRED EMBODIMENTS

Figure 1:
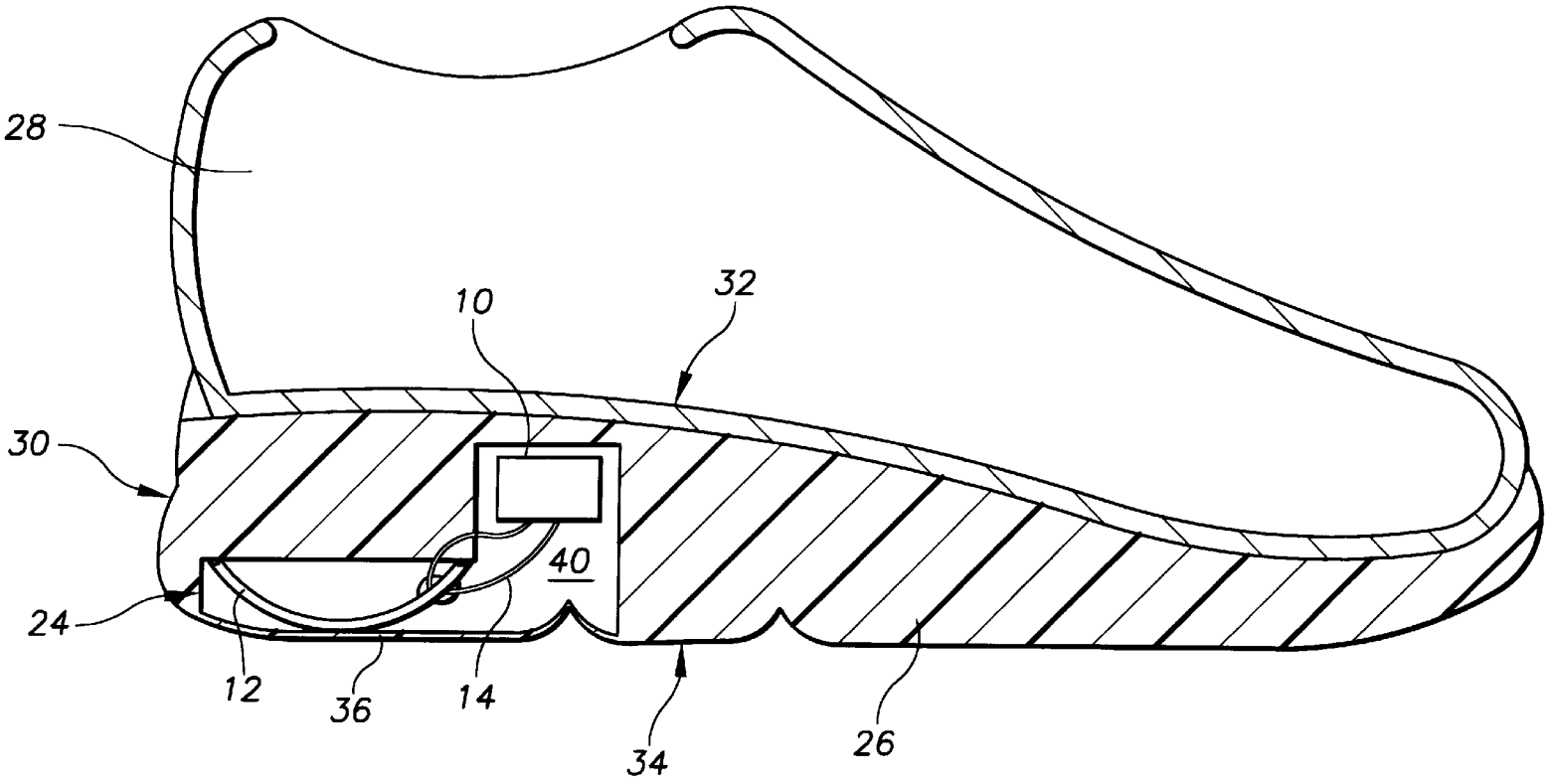
FIG. 1 is a side elevation with a shoe in phantom showing a piezoelectric spring system constructed in accordance with the present invention.

As seen in FIG. 1, modern footwear, particularly the type of athletic and casual shoes to which the present invention is readily adapted, typically comprise a soft, flexible upper portion 28 adapted to surround at least a portion of the upper surface of a wearer's foot, and a resilient sole portion 26 attached to the bottom of the upper portion 28 and adapted to underlie the wearer's foot and protect it against uncomfortable contact with the ground.

Typical materials for the upper portion 28 include leather and man-made sheet materials, such as polyvinyl or polyurethane sheets, or combinations of these, which are die- or laser-cut and then stitched together over a foot-shaped last to form the finished upper 28. The sole portion 36 is typically molded of man-made elastomeric materials, such as foamed or solid polyurethane or ethylene vinyl acetate, to include certain common structural features, such as a top, or "footbed," surface 32, a peripheral sidewall surface 30, and may further comprise a series of layered components, such as an outsole component, a midsole component, and an insole component (not illustrated). The sole portion 26 is attached on its upper surface 32 to a lower margin of the upper portion 28, typically by adhesive means.

As shown in FIG. 1, a piezoelectric spring system 24 is advantageously disposed in or molded into a cavity 40 located in a rear portion, or heel portion, of the sole portion 26, such that when the contact surface 34 of the sole portion 26 impacts the ground 44 the piezoelectric spring system 24 is actuated. It should be understood that the piezoelectric spring system 24 is mounted in the sole portion 26 substantially near the contact surface 34, such that the energy transferred to the piezoelectric spring system 24 by the impact of the contact surface 34 with the ground 44 is maximized, and attenuation of said energy in the section 36 of the sole portion 26 between the ground 44 and the piezoelectric spring system 24 is minimized.

Figure 2:
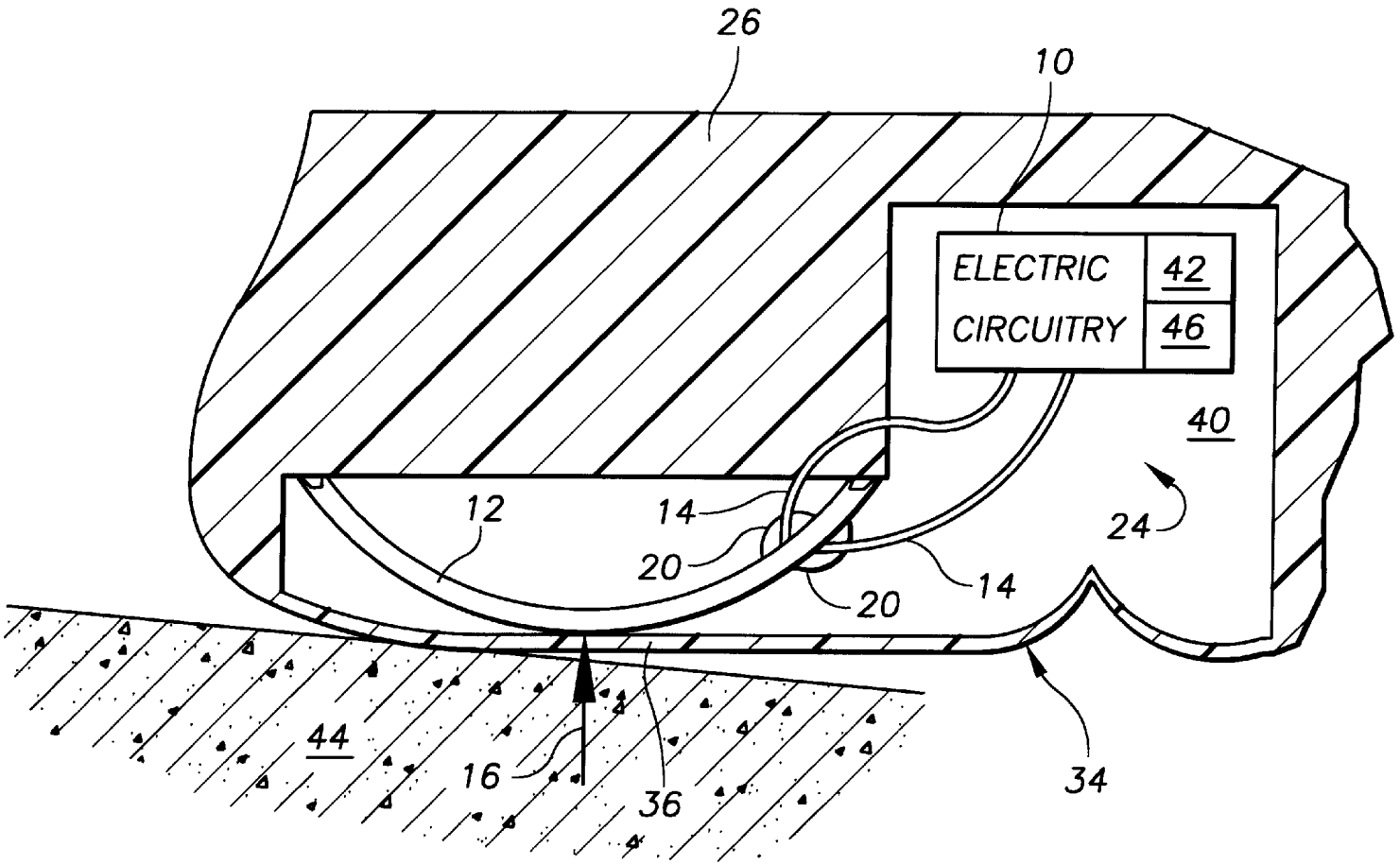
FIG. 2 is a side elevation of the piezoelectric spring system shown in FIG. 1 with a first force being applied to the piezoelectric element.

As shown in FIG. 2, in the preferred embodiment of the present invention, the piezoelectric spring system 24 comprises a piezoelectric actuator element 12, electrical wires 14 and energy storage circuitry 10. In the preferred embodiment of the invention, the actuator element 12 is a flextensional piezoelectric transducer. Various constructions of flextensional piezoelectric transducers may be used (including, for example, "moonies", "rainbows", and other unimorph, bimorph, multimorph or monomorph devices, as disclosed in U.S. Pat. No. 5,471,721), but the actuator element 12 preferably comprises a Thin Layer Unimorph Driver and Sensor, "THUNDER™," (as disclosed in U.S. Pat. No. 5,632,841) actuator constructed in accordance with the following description.

Figure 5:
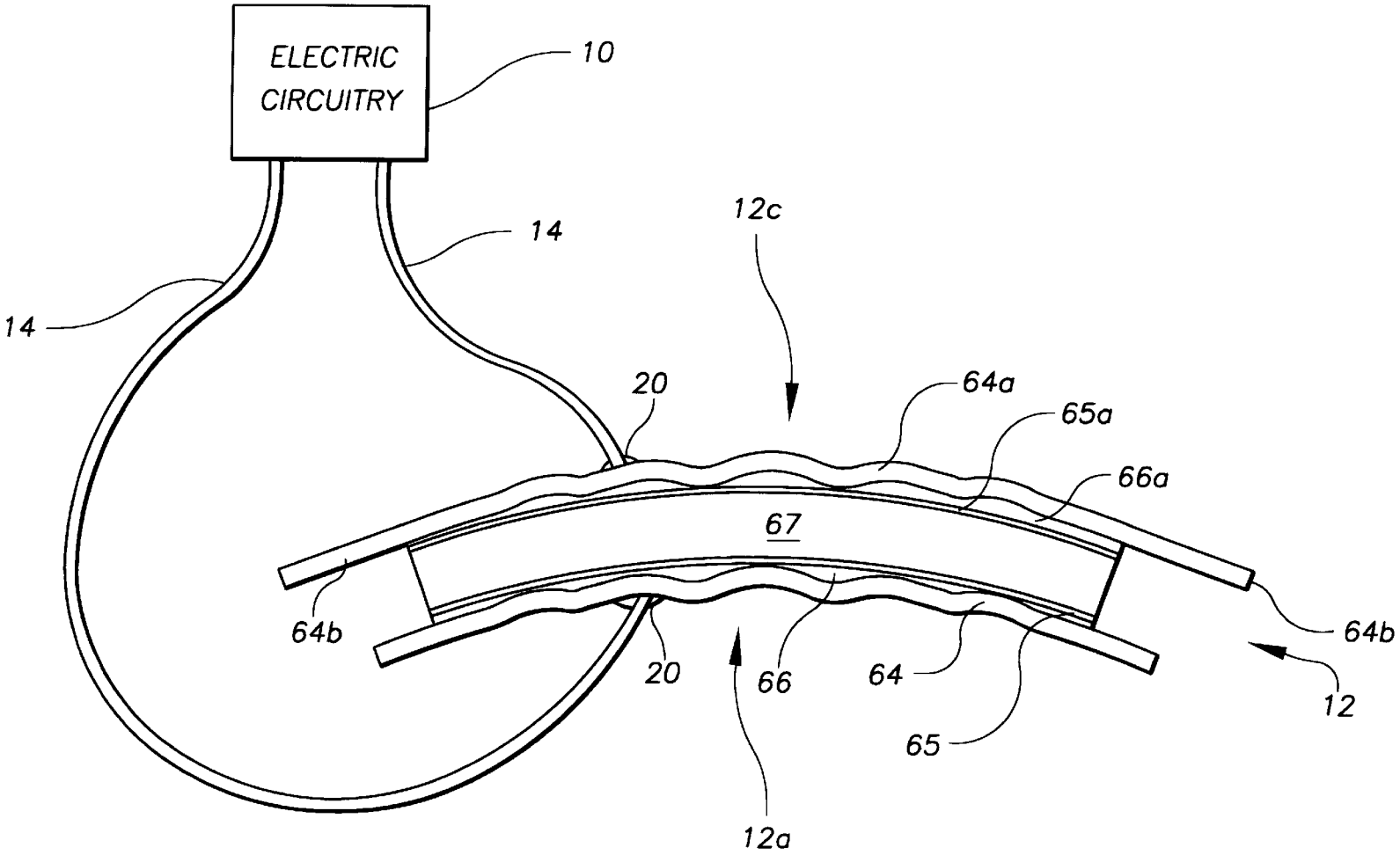
FIG. 5 is a side elevation of a piezoelectric actuator element used in the preferred embodiment of the present invention, showing details of construction of an actuator element.

THUNDER actuators 12 are composite structures such as is illustrated in FIG. 5. Each THUNDER actuator 12 is preferably constructed with a PZT piezoelectric ceramic layer 67 which is electroplated 65 and 65*a* on its two opposing faces. A steel, stainless steel, beryllium alloy or other metal first pre-stress layer 64 is adhered to the electroplated 65 surface on one side of the ceramic layer 67 by a first adhesive layer 66. The first adhesive layer 66 is preferably LaRC™-SI material, as developed by NASA-Langley Research Center and disclosed in U.S. Pat. No. 5,639,850. A second adhesive layer 66*a,* also preferably comprising LaRC-SI material, is adhered to the opposite side of the ceramic layer 67. During manufacture of the THUNDER actuator 12 the ceramic layer 67, the adhesive layers 66 and 66*a* and the first pre-stress layer 64 are simultaneously heated to a temperature above the melting point of the adhesive material, and then subsequently allowed to cool, thereby re-solidifying and setting the adhesive layers 66 and 66*a*. During the cooling process the ceramic layer 67 becomes compressively stressed, due to the higher coefficient of thermal contraction of the material of the pre-stress layer 64 than for the material of the ceramic layer 67. Also, due to the greater thermal contraction of the laminate materials (e.g. the first pre-stress layer 64 and the first adhesive layer 66) on one side of the ceramic layer 67 relative to the thermal contraction of the laminate material(s) (e.g. the second adhesive layer 66*a*) on the other side of the ceramic layer 67, the ceramic layer deforms in an arcuate shape having a normally concave face 12*a* and a normally convex face 12*c,* as illustrated in FIG. 5. One or more additional pre-stressing layer(s) 64*a* may be similarly adhered to either or both sides of the ceramic layer 67 in order, for example, to increase the stress in the ceramic layer 67 or to strengthen the actuator 12.

Electrical energy may be introduced to or recovered from the actuator element 12 by a pair of electrical wires 14 attached at one end to opposite sides of the actuator element 12. The opposite ends of the electrical wires 14 are connected to the electric energy storage circuitry 10. As discussed above, the pre-stress layers 64 and 64*a* are preferably adhered to the ceramic layer 67 by LaRC-SI material. The wires 14 may be connected (for example by glue or solder 20) directly to the electroplated 65 and 65*a* faces of the ceramic layer 67, or they may alternatively be connected to the pre-stress layers 64 and 64*a.* LaRC-SI is a dielectric. When the wires 14 are connected to the pre-stress layers 64 and 64*a,* it is desirable to roughen a face of each pre-stress layer 64 and 64*a,* so that the pre-stress layers 64 and 64*a* intermittently penetrate the respective adhesive layers 66 and 66*a,* and make electrical contact with the respective electroplated 65 and 65*a* faces of the ceramic layer 67.

Figure 3:
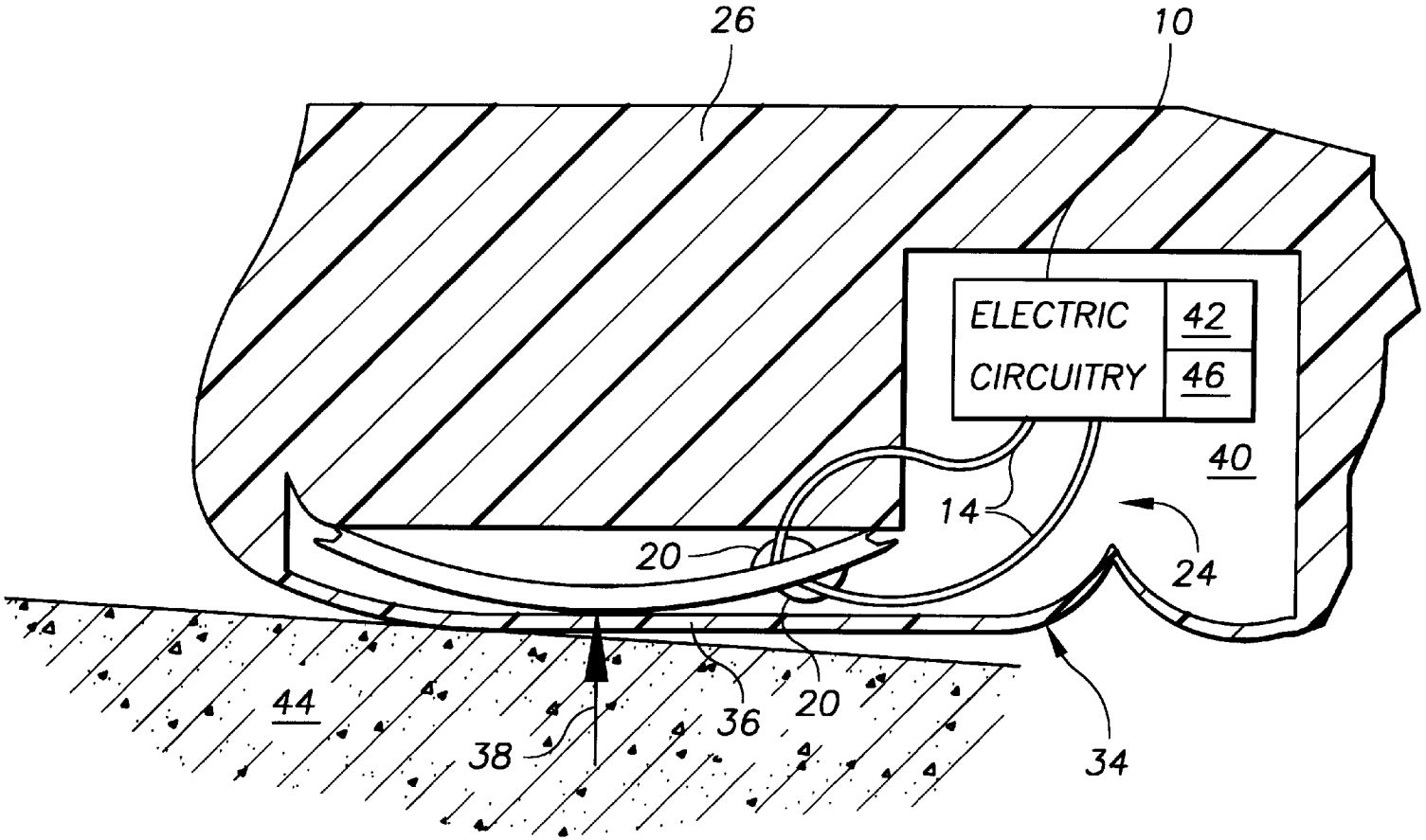
FIG. 3 is a side elevation of the piezoelectric spring system shown in FIG. 1 with a second force being applied to the piezoelectric element.
Figure 4:
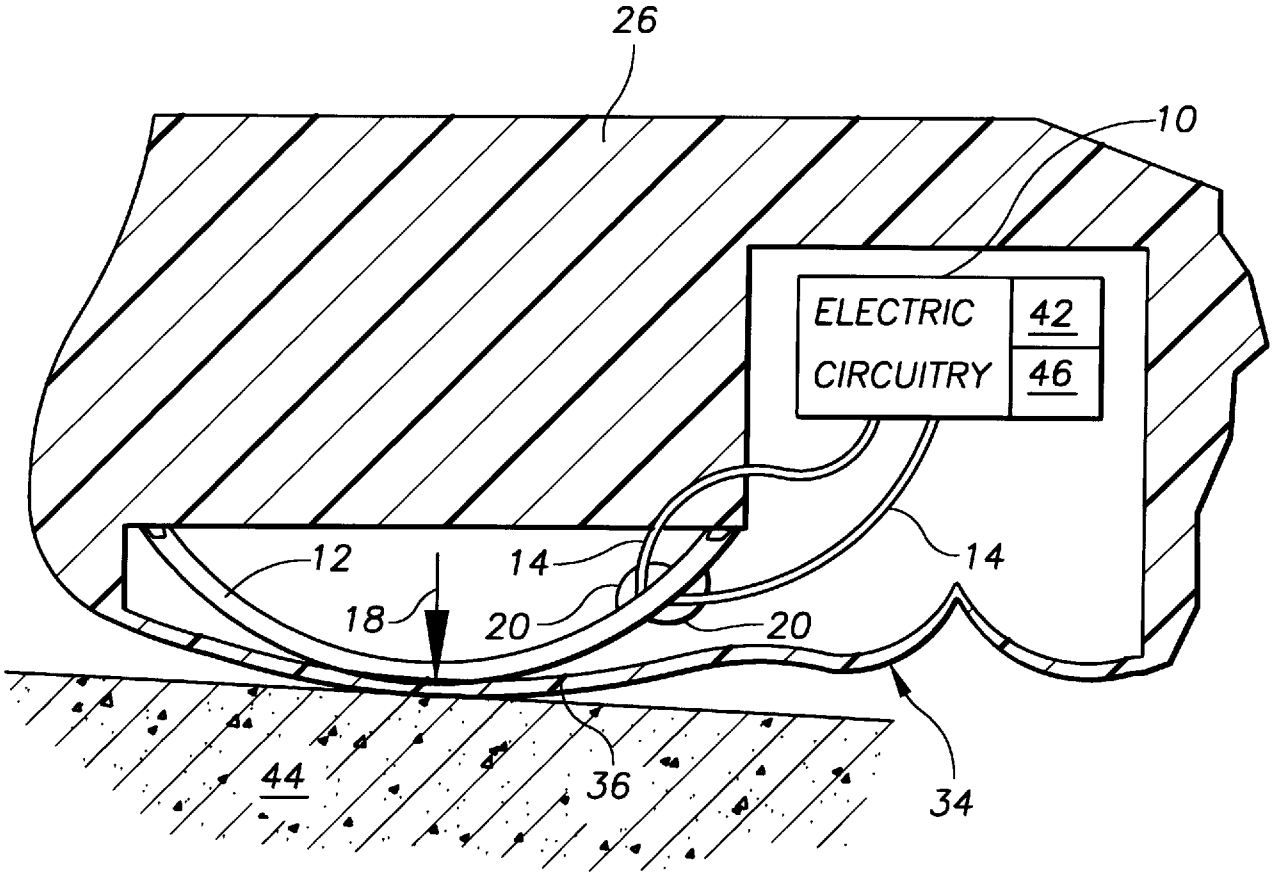
FIG. 4 is a side elevation of the piezoelectric spring system shown in FIG. 1 after the stored electrical energy has been applied to the piezoelectric element.

In operation, as shown in FIG. 2, as the wearer of the shoe walks or runs, each time the contact surface 34 of the sole portion 26 impacts the ground 44 or similar surface a first force (indicated by arrow 16 in FIG. 2) substantially normal to the contact surface 34 of the sole portion 26, deforms the section 36 of the sole portion 26 between the contact surface 34 and the piezoelectric element 12, which, in turn, deforms the piezoelectric element 12. By virtue of the piezoelectric effect, the deformation of the piezoelectric element 12 at each impact produces a pulse of electrical energy. The pulse or pulses of electrical energy are transmitted via the electrical wires 14 to the electrical energy storage circuitry 10. The electrical energy storage circuitry 10 comprises sensing means 42 for sensing a second force 38 (as shown in FIG. 3) which is large enough to deform the piezoelectric element 12 a predetermined amount (said second force 38 being greater than said first force 16), and for sensing when said second force 38 is released from the piezoelectric element 12. The second force 38 may be a result of running, jumping, skipping or the like. The electrical energy storage circuitry further comprises switching means 46 which is in electrical communication with said sensing means 42. The electrical energy storage circuitry 10 stores the energy generated by the piezoelectric element 12 until the sensing means 42 senses the application and release of the second force 38 from the piezoelectric element 12, at which time substantially all of the energy stored in the electrical energy storage circuitry 10 is reapplied by the switching means 46 to the piezoelectric element 12, which deforms (springs) in direct proportion to the amount of electrical energy applied. As described above, in the preferred embodiment of the invention, the piezoelectric element 12 is advantageously prestressed so that substantially all of the deformation generated as a result of the reapplication of the stored electrical energy is in a direction opposite to that of the first and second forces 16 and 38 (as shown by arrow 18 in FIG. 4). The force 18 generated by this deformation is transmitted through the section 36 between the piezoelectric element 12 and the contact surface 34, and to the ground 44 as shown in FIG. 4.

For example, as the wearer of the footwear runs, a first force 16 deforms the piezoelectric element 12 during each impact of the contact surface 34 with the ground 44, as shown in FIG. 1. As the wearer begins to jump, a second force 38, greater than the first force 16, is transmitted through the sole portion 26, and causes the piezoelectric element 12 to deform, as shown in FIG. 3. This second force 38 is sensed by the sensing means 42. Subsequently, at the instant the sensing means senses that the second force 38 is being released (i.e., as the wearer is about to leave the ground 44), the switching means 46 reapplies the stored energy to the piezoelectric element 12, which deforms. As shown in FIG. 4, the deformation of the piezoelectric element 12 deforms the section 36 of the sole portion 26 between the contact surface 34 and the piezoelectric element 12, thus creating a force 18 against the ground 44 and enabling the wearer to jump higher.

While the above description contains many specificities, these should not be construed as limitations on the scope of the invention, but rather as an exemplification of one preferred embodiment thereof. Many other variations are possible, for example:

Two piezoelectric elements 12 may be employed;

one for supplying electrical energy to the electrical energy storage circuitry 10, and one for springing, or;

Both for supplying electrical energy to the electrical energy storage circuitry 10, and both for springing;

More than two piezoelectric elements 12 may be employed;

The electrical energy storage circuitry 10 may comprise an amplifier, for amplifying the voltage applied to the piezoelectric element(s) 12;

Adhesives, preferably polyimides, other than LaRC-Si may be used to bond adjacent layers of the flextensional actuators together;

The piezoelectric spring system 24 may be mounted in the instep of the shoe to aid in kicking;

The electrical energy storage circuitry 10 may comprise a capacitor or capacitors for storage of the electrical energy;

The electrical energy storage circuitry 10 may comprise switching means for actuating the piezoelectric element 12;

The piezoelectric element may comprise a snap-action ferroelectric transducer.

Accordingly, the scope of the invention should be determined not by the embodiment illustrated, but by the appended claims and their legal equivalents.

I claim:

1. An article of performance enhancing footwear, comprising:

a shoe upper member having a bottom edge;

a sole member having a footbed, a contact surface, a heel portion, an instep portion, and a deformable resilient section;

said bottom edge of said shoe upper member being attached to said footbed;

said sole member having a cavity between said contact surface and said footbed, said cavity having an upper surface and a lower surface;

said deformable resilient section being disposed between said lower surface of said cavity and said contact surface;

a piezoelectric spring apparatus within said cavity, said piezoelectric spring apparatus comprising;

a piezoelectric actuator element having top and bottom opposing major surfaces;

said bottom major surface of said piezoelectric actuator element being in mechanical contact with said lower surface of said cavity;

said top major surface of said piezoelectric actuator element being in mechanical contact with said upper surface of said cavity;

an electrode on each of said top and bottom opposing major surfaces; and energy storage means for storing piezoelectrically generated electrical energy, said energy storage means being in electrical communication with each of said electrodes;

whereby, upon application of a first force to said contact surface, said first force causes a deformation of said resilient deformable section;

and whereby said deformation of said resilient deformable section causes a deformation of said piezoelectric actuator element, thereby piezoelectrically generating electrical energy with said piezoelectric actuator element.

2. The performance enhancing footwear of claim 1, wherein said piezoelectric spring apparatus further comprises switching means for releasing stored piezoelectric electrical energy from said energy storage means;

said switching means being in electrical communication with said energy storage means; and said switching means being in electrical communication with said electrodes.

3. The performance enhancing footwear of claim 2, wherein said piezoelectric spring apparatus further comprises sensing means for sensing application of said first force to said contact surface and for sensing application of a second force and release of said second force from said contact surface;

said second force being greater than said first force;

said sensing means being in communication with said piezoelectric actuator element; and said sensing means being in electrical communication with said switching means;

whereby said sensing means may operate said switching means upon sensing a release of said second force from said contact surface.

4. The performance enhancing footwear of claim 3, wherein said piezoelectric spring apparatus further comprises amplification means for amplifying piezoelectric electrical energy released from said energy storage means;

said amplification means being in electrical communication with said switching means; and said amplification means being in electrical communication with said electrodes.

5. The performance enhancing footwear of claim 4, wherein said cavity for said piezoelectric spring apparatus is in said heel portion or in said instep portion of said sole member.

6. The performance enhancing footwear of claim 5, wherein said piezoelectric actuator element comprises a normally curved prestressed piezoelectric ceramic transducer.

* * * * *